US005947236A

United States Patent [19]

Sauter

[11] Patent Number: 5,947,236

[45] Date of Patent: Sep. 7, 1999

[54] TRUCK MOUNTED BRAKE FOR STANDARD AND PREMIUM RIDE TRUCKS

[75] Inventor: Jeffrey F. Sauter, Lowville, N.Y.

[73] Assignee: New York Air Brake Corporation, Watertown, N.Y.

[21] Appl. No.: 08/874,228

[22] Filed: Jun. 13, 1997

[51] Int. Cl.[6] ..... B61H 13/00

[52] U.S. Cl. ..... 188/228.1; 188/228.6; 188/233.3; 188/233.7; 29/402.08

[58] Field of Search ..... 188/219.1–233.7, 188/205 R, 207, 52, 53, 51, 49, 54, 234; 29/402.01, 402.03, 402.08

[56] References Cited

U.S. PATENT DOCUMENTS

| | | | |
|---|---|---|---|
| 568,044 | 9/1896 | Robischung | 188/228.1 |
| 575,420 | 1/1897 | Farley | 188/228.1 |
| 796,714 | 8/1905 | Frost | 188/233.3 |
| 979,968 | 12/1910 | Kofske | 188/233.3 |
| 1,144,403 | 6/1915 | Williams, Jr. | 188/233.7 |
| 1,203,469 | 10/1916 | Busse | 188/228.1 |
| 2,116,594 | 5/1938 | Busch . | |
| 2,182,210 | 12/1939 | Osner et al. | 188/228.6 |
| 2,329,247 | 9/1943 | Busse et al. . | |
| 2,480,857 | 9/1949 | Hess | 188/228.6 |
| 2,491,086 | 12/1949 | Busch . | |
| 2,517,199 | 8/1950 | Gothberg . | |
| 2,885,036 | 5/1959 | Walker | 188/225.6 |
| 3,499,507 | 3/1970 | Scott et al. . | |
| 3,907,078 | 9/1975 | Means . | |
| 4,653,812 | 3/1987 | Engle . | |
| 4,766,980 | 8/1988 | Engle . | |
| 4,771,868 | 9/1988 | Haydu . | |
| 4,793,446 | 12/1988 | Hart et al. . | |
| 5,069,312 | 12/1991 | Kanjo et al. . | |
| 5,400,874 | 3/1995 | Gayfer et al. . | |
| 5,495,921 | 3/1996 | Samulak et al. . | |

*Primary Examiner*—Douglas C. Butler
*Attorney, Agent, or Firm*—Barnes & Thornburg

[57] ABSTRACT

A truck mounted rail brake including at least a primary beam having a hollow center section and a pair of end sections with guide feet to be received in the slots of the truck and a brake shoe thereon. The end sections are slidable within the center section between an extended and a contracted position and removable fasteners lock the end sections in their extended position. The center portion includes at least one channeled element having a horizontal base and two vertical walls.

14 Claims, 3 Drawing Sheets

TRUCK MOUNTED BRAKE FOR STANDARD AND PREMIUM RIDE TRUCKS

BACKGROUND AND SUMMARY OF THE INVENTION

The present invention relates generally to brake apparatus for rail cars, and more specifically to truck mounted brake apparatus.

Truck mounted brakes throughout the railroad industry include either a double actuator system as illustrated in U.S. Pat. No. 3,499,507 or a single actuator system as illustrated in U.S. Pat. Nos. 5,400,874 and 5,495,921. In all three of these systems, the actuator rods extend through holes in the bolster of the truck. The primary and secondary beams are unitary cast iron beams. The beams are U-channeled having a vertical base and two horizontal walls extending therefrom. The actuator or actuators are mounted to the vertical base and the actuator rods are mounted and extend through openings also in the vertical base.

Another example of a truck mounted brake having a single actuator is illustrated in U.S. Pat. Nos. 4,766,980 and 4,653,812. By moving the actuator rods outside of the center section, they pass under the bolster of the truck and no holes through the bolsters are required. The brake beams are shown as having a rolled steel center channel section with end sections having cast brake shoe heads and projecting guide feet bolted to the center section. As with the previous unitary beams, the channeled portion is generally U-shaped having a vertical base wall with two opposed horizontal walls extending therefrom.

There is a continuous drive to reduce the cost, size and weight of the truck mounted brake.

The present invention is a truck mounted rail brake including at least a primary beam having a hollow center section and a pair of end sections with guide feet to be received in the slots of the truck and a brake shoe thereon. The end sections are slidable within the center section between an extended and a contracted position and removable fasteners lock the end sections in their extended position. The center portion includes at least one channeled element having a horizontal base and two vertical walls. The center portion may also include at least two opposed channel elements, each having a horizontal base and two vertical walls drawn by the fasteners. The brake actuator is supported by the primary beam and preferably by the end sections.

A second brake beam may be included also having a hollow center section with a pair of end sections slidable therein and include guide feet and brake shoes on the end sections which are fastened in their extended position to the center section. The second beam also includes at least one channel member having a horizontal base and two vertical walls. Force transmitters, or rods, which extend from the actuator, are connected to the secondary beam. The force transmitters may extend around the truck or through the truck.

A method for moving the brake beam of the present invention from a truck includes unlocking the end portion of the brake beam from the center portion, contracting the end portion into the center portion sufficient to remove the guide foot of the contracted end portion from the truck and finally, moving the contracted end portion with respect to the truck sufficient to remove the other end of the brake beam from the truck. The force transmission elements or rods have to be removed in order to remove the beam.

A method for replacing the brake heads on the truck would also include unlocking an end portion which includes the brake head to be removed from the center portion of the beam, contracting the end portion into the center portion sufficient to remove the brake foot from the truck, moving the contracted end portion with respect to the truck sufficient to remove the contracted end portion from the center portion and finally, extending the contracted end portion from the center portion until it is removed. This allows removal of the end portion without removing the total beam from the truck.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
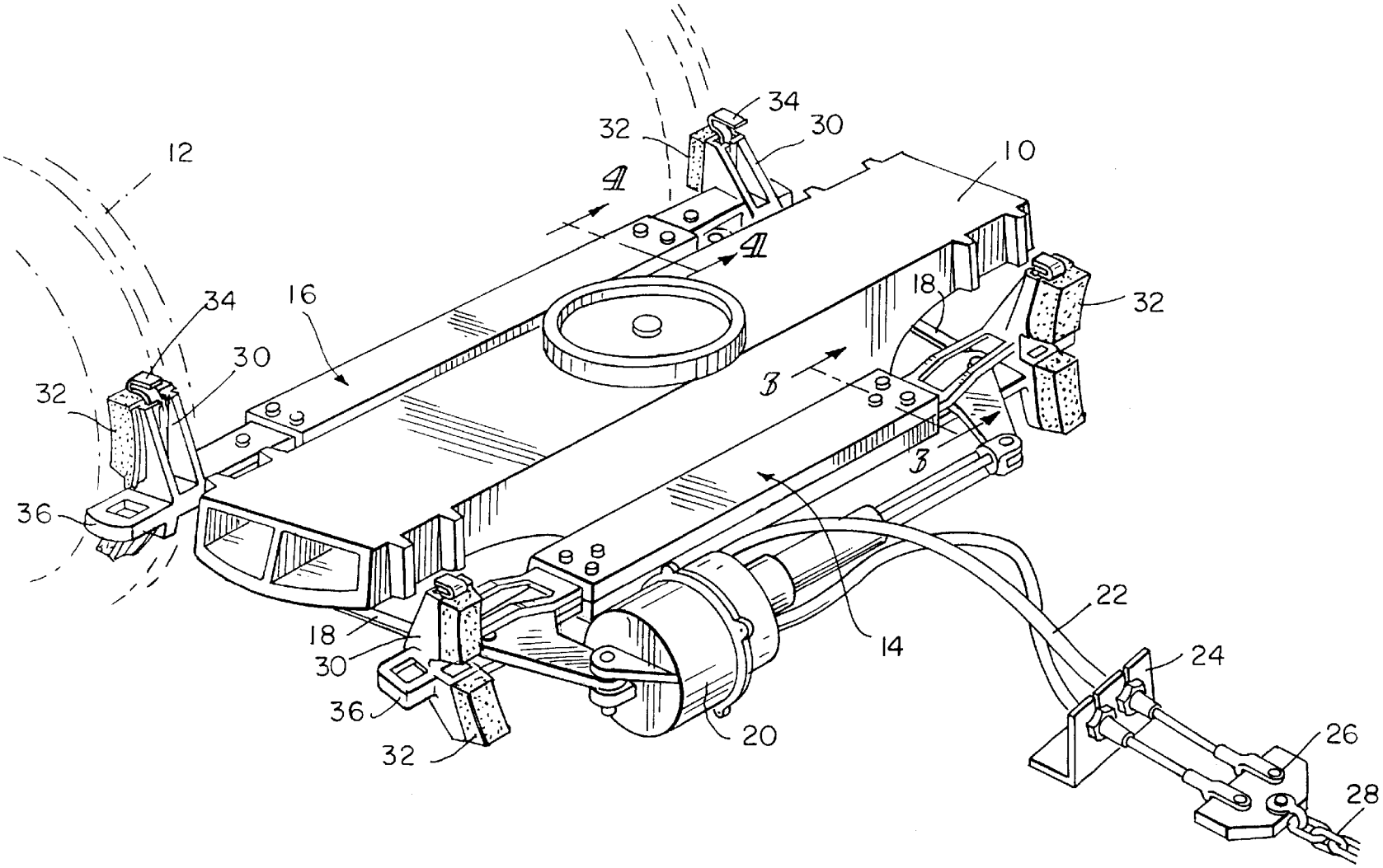
FIG. 1 is a perspective view of a truck mounted brake mounted to the truck incorporating the principles of the present invention.

A truck mounted brake is shown in FIG. 1 with respect to bolster 10 of the truck and a wheel 12. The illustration is for a double axle truck and therefore will be described with respect to two brake beams. It should be noted that the system may also be used with a single axle and therefore a single brake beam.

Figure 2:
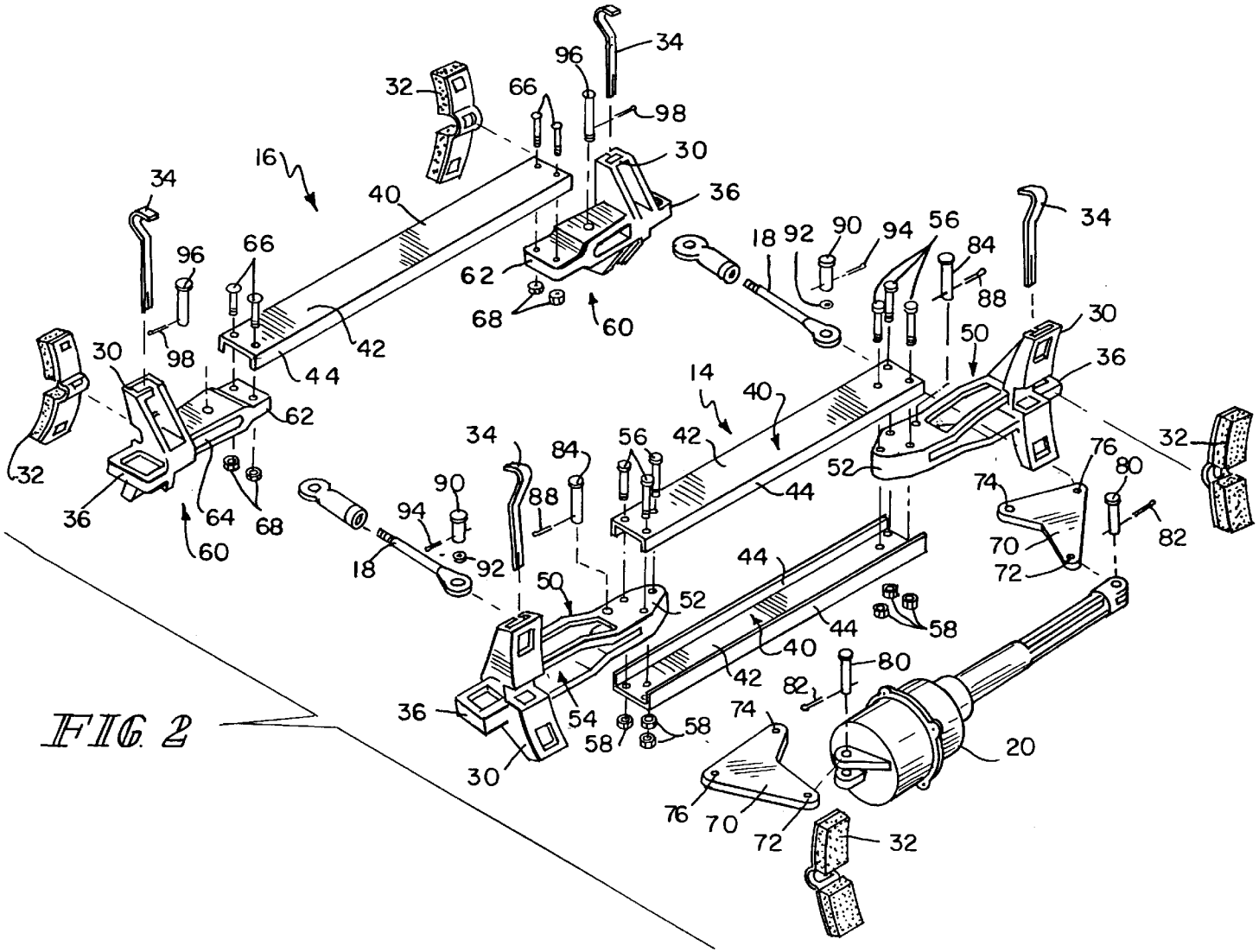
FIG. 2 is an exploded view of the truck mounted brake incorporating the principles of the present invention.

The truck mounted brake illustrated in FIGS. 1 and 2 include a primary brake beam 14 and a secondary brake beam 16 on opposite sides of the bolster 12 and interconnected by force transmission or push rod assembly 18. An actuator 20 is supported by the primary beam 14 and is connected to the secondary beam 16 by the push rods 18. A hand brake cable 22 is connected to the actuator 20 and to cable reaction bracket 24, equalization plate 26 and chain 28.

At each end of the primary beam 14 and the secondary beam 16, is a brake head 30 having brake shoes 32 secured thereto by removable latch 34. Also, extending from the ends of each of the brake beams are guide feet 36 which are received in slots in the side walls of the truck. Each of the brake heads 30 and brake shoes 32 are adjacent to respective wheel 12, only one of which is illustrated.

The system so far described is well known in the industry and is illustrated for example, in U.S. Pat. Nos. 4,766,980 and 4,653,812. The operation of the actuator 20, with or without slack adjusters, and the push rod assemblies 18 to operate the pair of brake beams 14 and 16 is well known and will not be described here in detail.

Figure 3:
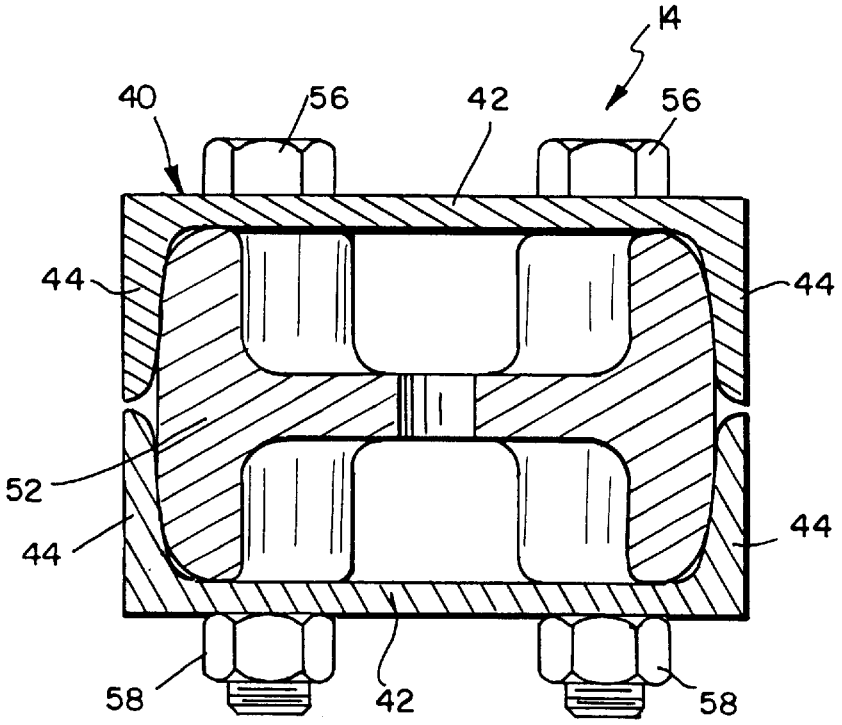
FIG. 3 is a cross section taken along lines III—III of FIG. 1 of the primary beam.
Figure 4:
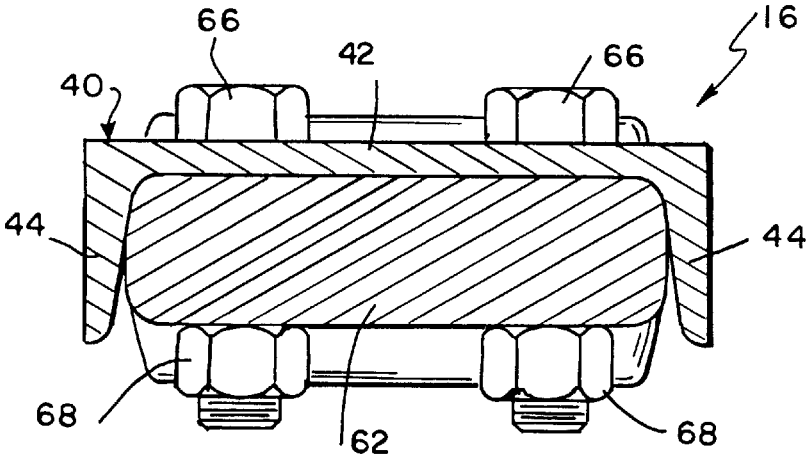
FIG. 4 is a cross section taken along lines IV—IV of FIG. 1 of the secondary brake beam.

The improved brake beam system of the present invention is illustrated in detail in FIGS. 2–4. The primary beam 14 and the secondary beam 16 each include a center portion having one or more channeled elements 40 each including a horizontal base 42 and pair of vertical side walls 44. While the secondary beam 16 includes only one channel member 40, the primary beam 14 includes a pair of opposed channel members 40. In both beams, the base 42 is horizontal and the side walls 44 are vertical. This increases the stiffness of the center of the beams to braking forces transverse to the side walls 44 and within the plane of the base 42. This is to be distinguished from the U-shaped beams of the prior art wherein the corresponding base wall 42 is vertical and the corresponding side walls 44 are horizontal.

The specific orientation and design of the present center sections 40 allows them to be standard U or C channels stock of substantially reduced weight compared to that of the prior art brake beams. Initial results show almost a 50% reduction of weight compared to beams presently in use. Another advantage of using stock channels for the center portion of the beam is ease of modification for different gauge tracks. No redesign or special forging is needed.

The primary brake beam 14 includes a pair of end portions 50 having a tongue portion 52 slidably received within the channel of the center portion 40. An opening 54 is provided in the end portion 50 for the force transmission mechanism. Fasteners 56 extend through aligned apertures in the base wall 42 of the center section and the tongue 52 of the end portion and into nuts 58 to secure the end portions in their extended position relative to the center portion 40. Fasteners 56 secure or lock the end portions in their extended position and secure the pair of center portions 40 to each other.

The secondary beam 16 also includes a pair of end portions 60 having a tongue 62 received within the channel of the center portion 40. A pair of fasteners 66 extend through the horizontal wall 42 of the center portion 40 and through aligned apertures in the tongue 62 of the end section 60 and into nuts 68 to secure the end sections in their extended position relative to the center portion 40.

The actuator 20 is supported by the primary brake beam 16 through bell crank lever 70. Opposite ends of the actuator 20 are secured by pins 80 received through aperture 72 in the bell crank 70. A cotter pin 82 connected through the end of the pin 80. The bell crank 70 is pivotally connected to the end portion 50 in opening 54 of the first beam by a pin 84 received in aperture 74. A cotter pin 88 is provided at the end of pin 84 to secure it in place. One end of the push rod assembly 18 is secured to the bell crank 70 by a pin 90 received in aperture 76 of the bell crank 70. A bushing 92 is provided in the end of the bush rod assembly 18 and a cotter pin 94 holds the pin 90 in place. The other end of the push rod 18 is received in opening 64 of the end section 60 of the second beam 16 and is secured therein by pin 96 and cotter pin 98.

A method of removing either of the brake beams 14 and 16 from the truck mounted brake includes disconnecting the push rod assembly 18 from the ends of the beam to be removed by removing one of the pins 90 or 96 or pin 84 for the bell crank 70. Next, the fasteners 56 or 66 are also removed to allow one end portion 50 or 60 of the brake beam to be moved from its extended to its contracted position sliding within the center channel portion 40. This will remove the foot guide 36 from the slot of the truck. This contracts the overall length of the beam sufficient to allow not only removal of the foot guide 36 from the end which has been contracted, but also foot guide 36 of the other end which is still in its extended position. For example, the difference between the extended and contracted position could be for example, three to five inches. The tongues 52 and 62 of the end portions 15 and 16 are so designed to allow that amount of contraction. It should be noted that only one of the end portions 50 or 60 need be moved from its extended to its contracted position to remove the whole beam.

To remove just one of the ends 50 or 60 to replace either the brake head 30 or the brake shoe 32, the fasteners 56 or 66 of that end are removed and the end portion 50 or 60 is contracted from its extended position into the center channel section 40. The brake beam 14 or 16 is then repositioned relative to the truck sufficiently to allow the contacted end portion 50 or 60 to be re-extended and removed from the center portion 40. This can be accomplished without removing the total beam 14 or 16 from the truck. As in the total beam, the end of the push rod assembly 18 must be disconnected from the end portion 50 or 60 which is to be removed.

The method of assembly is the reverse of the method of disassembly wherein one end portion 50 or 60 of the brake beam 14 or 16 is secured to the center section in its extended position and the other end portion is contracted. Upon insertion of the foot guide 36 of the extended end portion into the slot in the truck, the other end is extended to its extended position with its foot guide 36 being received in a slot in the truck and it is secured in its extended position by appropriate fasteners 56 or 66.

Although the present system has been described with respect to push rods 18 extending around the bolster 10, the present brake beams, with minor modification, can also be used where the push rods 18 and the actuator 20 extend toward and/or through openings in the bolster. This will cause minor modification of the center portion 40 with no modification of the end portions 50 and 60 nor their operation. This would also increase the weight of the center portions 40 to receive the actuator 20 and the push rod assemblies 18 and their interconnected mechanisms. Similarly, although a pair of brake beams are shown, a single brake beam system can also be used using either the primary beam 14 or the secondary beam 16.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A truck mounted rail brake comprising:

at least primary beam having a hollow center section and, at each end, an end section secured thereto by a removable fastener and having a guide foot to be received in slots in a truck and a brake shoe;

a brake actuator connected to the primary beam;

the end sections being slidable within the center section between an extended position which positions the guide foot in the slot and a contracted position which positions the guide foot out of the slot; and the removable fasteners locking the end sections in the extended position.

2. A brake according to claim 1, wherein the center portion is at least one channeled element having a horizontal base and two vertical walls.

3. A brake according to claim 1, wherein said actuator is supported by the end sections.

4. A brake according to claim 1, including a secondary beam including:

a hollow center section and a pair of end sections slidable within the center section between an extended and a contracted position;

removable fasteners locking the end sections in the extended position; and the guide feet and the brake shoes being on the end sections.

5. A brake according to claim 4, wherein the center portion is at least one channeled element having a horizontal base and two vertical wall.

6. A brake according to claim 5, wherein the center portion of the primary beam is at least two opposed channeled elements joined by the fasteners.

7. A brake according to claim 4, wherein said actuator is supported by the primary beam and is connected by a force transmitter to the secondary beam.

8. A brake according to claim 7, wherein the force transmitter extends around the truck.

9. A brake according to claim 7, wherein the force transmitter extends through the truck.

10. A brake according to claim 7, wherein said actuator is supported by the end sections of the primary beam and the force transmitter is connected to the end section of the secondary beam.

11. A method of replacing a brake head on a truck mounted brake comprising:

unlocking, from a center portion of a brake beam, an end portion of the brake beam which includes the brake head to be removed;

contracting the end portion into the center portion sufficient to remove a guide foot of the contracted end portion from the truck;

moving the contracted end portion with respect to the truck sufficient to allow removal of the contracted end portion from the center portion; and extending the contracted end portion from the center portion until it is removed.

12. A method of removing a brake beam from a rail truck comprising:

unlocking an end portion of the brake beam from a center portion of the brake beam;

contracting the end portion into the center portion sufficient to remove a guide foot of the contracted end portion from the truck; and moving the contracted end portion with respect to the truck sufficient to remove a guide foot of the other end of the brake beam from the truck.

13. A truck mounted rail brake comprising:

at least primary beam having a hollow center section and, at each end, an end section secured thereto by a removable fastener and having a guide foot to be received in slots in a truck and a brake shoe;

a brake actuator connected to the primary beam;

the end sections slidable within the center section between an extended and a contracted position; and the center portion including at least one U or C-shaped channel stock element having a horizontal base and two vertical walls.

14. A brake according to claim 13, wherein the center portion is at least two opposed channel stock elements joined by the fasteners.

* * * * *